United States Patent [19]

Kayser et al.

[11] 3,985,053

[45] Oct. 12, 1976

[54] DEVICE FOR THE OPENING AND CONVEYANCE OF FRESHLY CUT STAPLE FIBER BUNDLES

[75] Inventors: Hans Dieter Kayser, Sulzbach; Wilhelm Dindorf, Obernburg, both of Germany

[73] Assignee: Akzona Incorporated, Asheville, N.C.

[22] Filed: Jan. 21, 1976

[21] Appl. No.: 651,088

[30] Foreign Application Priority Data

Jan. 23, 1975 Germany ..... 2502593

[52] U.S. Cl. ..... 83/100; 83/346; 83/913

[51] Int. Cl.[2] ..... D01G 1/04

[58] Field of Search ..... 83/100, 346, 913

[56] References Cited

UNITED STATES PATENTS

| | | | |
|---|---|---|---|
| 2,607,418 | 8/1952 | Hebeler | 83/913 X |
| 3,915,042 | 10/1975 | Laird | 83/913 X |
| 3,948,127 | 4/1976 | Vehling et al. | 83/100 |

*Primary Examiner*—Frank T. Yost
*Attorney, Agent, or Firm*—Francis W. Young; Tom R. Vestal

[57] ABSTRACT

The invention relates to a device for opening and conveying freshly spun staple fiber bundles. Said device is attached to a staple fiber cutter and consists of an axial blower with increased space between the fan blades and the interior wall of the casing.

7 Claims, 2 Drawing Figures

DEVICE FOR THE OPENING AND CONVEYANCE OF FRESHLY CUT STAPLE FIBER BUNDLES

BACKGROUND OF THE INVENTION

A major problem encountered in cutting tow into staple fiber bundles is conveyance of the cut staple in such a manner that subsequent opening required for further processing is not impeded by twist formation or the like. Such twist formation is often observed, especially when cutting long staple fiber. It is generally caused immediately after cutting by turbulence produced by air flow generated by the rotating cutting device. To avoid this phenomenon, attempts have been made to remove cut fiber bundles either by suction or blowing the bundles away from the cutting point. While this occasionally inhibits the formation of twists, there are other shortcomings. When long passages with various changing cross-sections are involved, wadding and lumping resulting in partial obstruction of the lines is usually unavoidable. During the subsequent opening process, this leads in part to serious problems. It has now been found that not only improved conveying of the fiber bundles away from the cutting point of a conventional cutter can be provided, but moreover that opening of the fiber bundle can be combined with such conveying when the suction opening of a specially modified radial blower, with exclusion of leaks, is located as close as possible to the cutting zone of the cutter.

While it has previously been suggested to use a radial blower for conveying the cut staple bundle from the cutting point (See U.S. Pat. No. 2,846,004), in this case not only was the blower located at considerable distance from the cutting point, but guides for the staple bundles exhibited marked changes in cross-sections and/or deflections; an increasing space was not provided between fan blades and housing. The objectives of the present invention could not be met thereby. The devices exhibited not only the described shortcomings, but felting and lumping presented serious difficulties when opening the staple bundles separated from the conveying stream. An additional serious drawback was that the staple was heavily damaged while traveling through the blower.

It was not expected that the combination of two unconventional procedures, (1) aligning the radial blower with its suction opening as close as possible to the cutting point, care being taken that at least the major portion of the intake air flows from one or from combined cutting points, and (2) providing—in distinct contradiction to generally accepted ideas on radial blowers—for an increasing space between fan blades and inside wall of the housing, would be so highly successful in opening and conveying the staple bundles.

SUMMARY OF THE INVENTION

The present invention is based on a device for the conveyance and opening of fiber bundles immediately after the bundles have been severed by a fiber cutter of a known type. Both steps are performed substantially simultaneously and in a manner that is extremely gentle to individual fibers. This is accomplished with a device for the opening and conveyance of freshly cut fiber bundles, consisting of a radial blower attached to the staple fiber cutter and characterized in that the radial blower is aligned with its suction intake close to the cutting zone in such a way that the cut fiber bundles are immediately admitted in the suction opening of the blower, and the blades of the blower rotor leave a space between blades and housing corresponding to at least half of the effective knife length of the cutting point of the staple cutter preceding the radial blower.

BRIEF DESCRIPTION OF THE DRAWINGS

The invention is explained in greater detail by the enclosed drawings wherein.

DETAILED DESCRIPTION OF THE DRAWINGS

Figure 1:
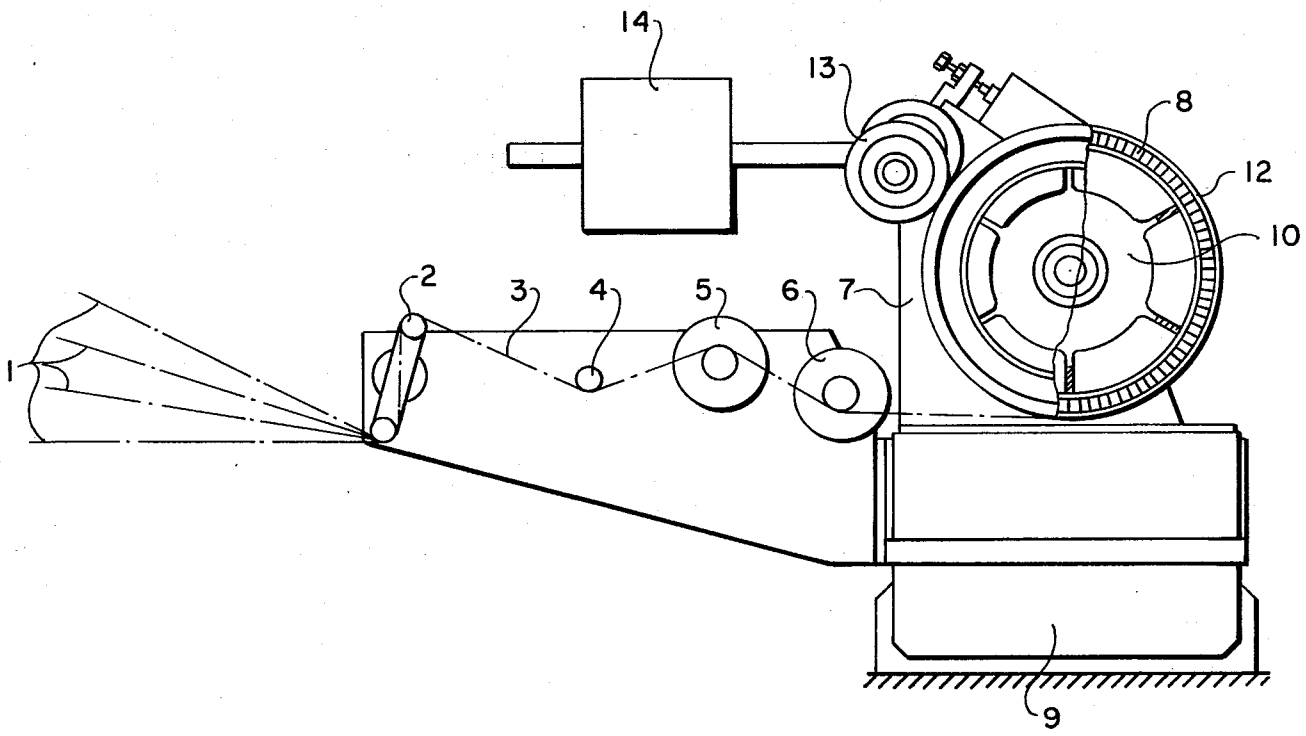
FIG. 1 shows a staple cutter with feeding tow.

In FIG. 1, a number of separate ends of filaments 1 are brought together at a converging ring 2 and formed into a tow 3. The tow is then passed over alignment guide 4 and rollers 5 and 6 and then to a staple cutting device 7 mounted on a base 9 and having a circular ring of outwardly facing knives 8 attached to a frame 10 that rotates about an axis perpendicular to the plane of the Figure. The tow is wrapped around the ring of knives 8 into a band 12 and pressure roller 13 is forced against the band 12 by weighted arm 14. The band is thereby forced against the knives 8 and, as additional layers of tow are added, each succeeding layer of the band of tow is cut by pressure of the roller 13 transmitted through band 12 to the knives.

Figure 2:
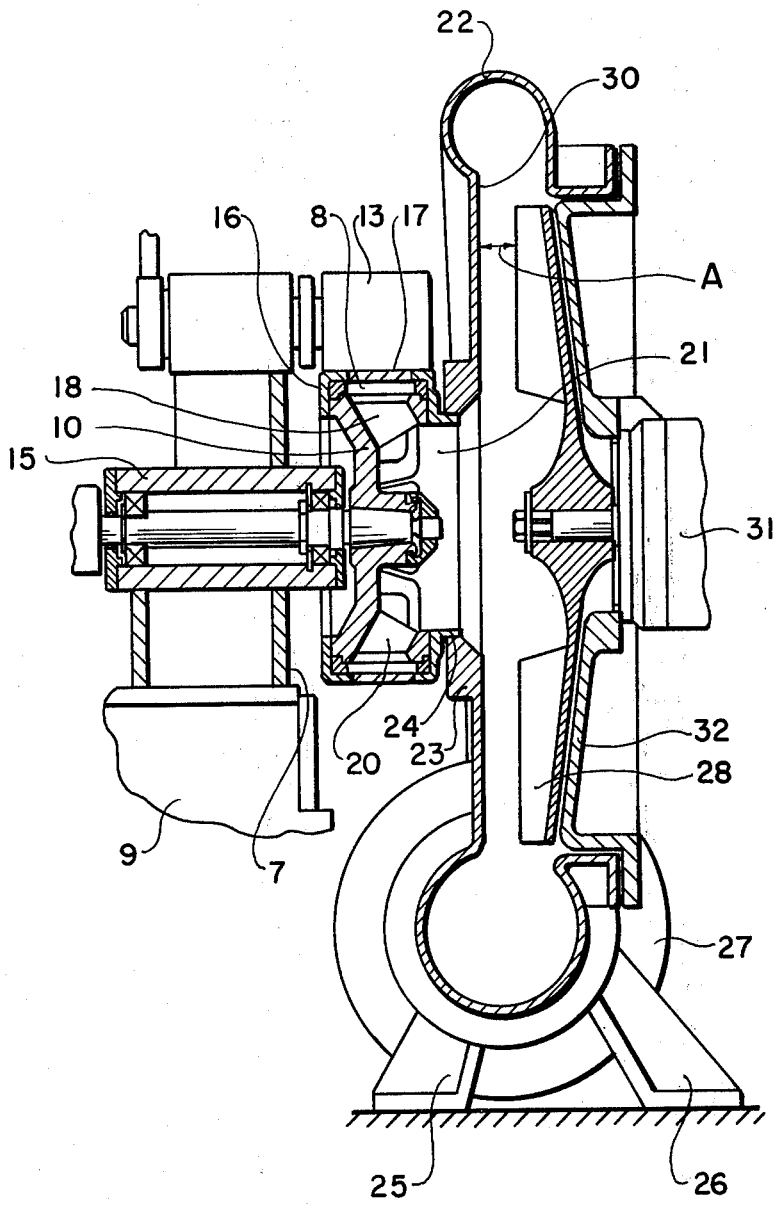
FIG. 2 is a longitudinal cross-section of a device according to the invention.

In FIG. 2, the staple cutter 7 is shown in more detail, including rotating means 15 for the frame 10 and rotatable housing 16 attached to frame 10 to support the knives 8 and assist in supporting the pressure of roller 13 as well as confine the band 12 in a cutting zone 17. Cut staple from the blades 8 are pushed down into passageways 18 formed in the frame 10 by radial spokes 20. The passageways 18 lead into a confined zone 21 and cut staple fibers are subjected to a blower action to be described later.

Blower housing 22, having an axis of rotation shown here approximately the same as the rotation of the cutting device 7, has a flange 23 fitting loosely over flange 24 on rotatable housing 16 of the cutting device to permit rotation of the housing 16 within the flange 23. Blower housing 22 is supported on base legs 25 and 26. Conduit flange 27 is located on the exhaust side of the blower housing 22 and additional conduit (not shown) transport the cut staple to a desired location. Rotor blades 28 are driven by drive means 31 rotatably mounted in end piece 32 fixedly attached to housing 22.

In the essence of this invention, it has been found that an optimum relation exists in the proximity of the blower housing 22 to the cutting device 7, and the spacing A of the blower rotor blades 28 from the inner surface 30 of the blower housing 22. Contrary to earlier teaching, it has been found that, incorporating the latter rotor spacing, it is more effective to have the blower located as close to the cutting device as possible. Specifically, it has been found that optimum spreading and minimum twisting of the cut staple fibers along with transport capability occurs when the spacing A is at least one half the effective knife length of the cutting points in the staple cutting device but greater than a minimum value of 5 to 8mm. Preferably the spacing is at least 0.8 times the effective knife length.

"Effective knife length" is understood to mean the length of the knife or individual knives coming into contact with the tow during the cutting process and is a simple measurement to be used for the preferred hydraulic diameter ($D_H$) of the tow bundle.

The hydraulic diameter $D_H$ is defined as 4 F/U where F is the cross-sectional area of the tow bundle and U is the circumference of the area. It has been found in conventional staple cutting devices that one half the effective knife length is between 0.7 to 1.2 $D_H$.

Care should be taken that the surface of the rotor blades 28 are not rough and sharp. The surfaces of the blower may be coated with polytetrafluoroethylene or similar material to aid in providing gentle treatment for the cut fibers. The rotor blades may also advantageously be made of resilient material capable of withstanding high centrifugal forces such as polyvinyl chloride, polyurethane, or rubber.

Staple fibers being pulled through passageways 18 into the confined zone 21 travel immediately at a high rate of speed and are pulled apart by the suctive force of the rotating rotor 28 before having a chance to entangle, providing an ideal cut staple for further operations and virtually eliminating the prior problem of entanglement when cut staple fibers have been pneumatically conveyed long distances from staple cutting devices.

What is claimed is:

1. Apparatus for opening and conveying freshly cut staple fibers comprising a radial blower having its suction opening attachable in close proximity to the cutting zone of a tow staple cutting apparatus, said radial blower having a blade type rotor, the blades of the rotor being spaced from the inner housing surface of the blower adjacent the cutting zone a distance at least one half the effective knife length of the staple cutting unit.

2. The apparatus of claim 1 wherein the spacing between the inner housing surface of the blower and the rotor blades is at least 0.8 times the effective knife length and not less than 5 to 8 millimeters.

3. The apparatus of claim 1 wherein the rotor blades are made of a readily elastically deformable material.

4. The apparatus of claim 3 wherein the blades are made from the materials group consisting of polyvinyl chloride, rubber, and polyurethane.

5. The apparatus of claim 1 wherein the rotor is coated with polytetrafluoroethylene.

6. The apparatus of claim 1 wherein the inner housing surface and rotor of the blower are coated with polytetrafluoroethylene.

7. The apparatus of claim 1 in which the effective knife length is between 0.7 to 1.2 times the hydraulic diameter $D_H$.

* * * * *